US007231979B2

(12) United States Patent
Stephen et al.

(10) Patent No.: US 7,231,979 B2
(45) Date of Patent: Jun. 19, 2007

(54) SHORT RADIUS WHIPSTOCK SYSTEM

(75) Inventors: Dave Stephen, Port Gentil (GA); James A. Sonnier, Houston, TX (US); Joseph P. Degeare, Houston, TX (US); Rustom K. Mody, Bellaire, TX (US); Mohan L. Soni, Katy, TX (US); Daniel R. Hart, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 648 days.

(21) Appl. No.: 10/755,489

(22) Filed: Jan. 12, 2004

(65) Prior Publication Data

US 2004/0144047 A1 Jul. 29, 2004

Related U.S. Application Data

(60) Provisional application No. 60/440,268, filed on Jan. 15, 2003.

(51) Int. Cl.
*E21B 29/06* (2006.01)

(52) U.S. Cl. ..... 166/298; 166/117.5; 166/55; 166/50

(58) Field of Classification Search ..... None
See application file for complete search history.

(56) References Cited

U.S. PATENT DOCUMENTS

| | | | | |
|---|---|---|---|---|
| 2,147,585 A | 2/1939 | Trotter | | |
| 2,687,282 A | 8/1954 | Sanders | | |
| 2,694,549 A | 11/1954 | James | | |
| 4,397,360 A | 8/1983 | Schmidt | | |
| 6,102,123 A | 8/2000 | Bailey et al. | | |
| 6,332,498 B1 * | 12/2001 | George | ..... | 166/50 |
| 6,405,804 B1 * | 6/2002 | Ohmer et al. | ..... | 166/377 |

FOREIGN PATENT DOCUMENTS

| | | |
|---|---|---|
| EP | 685628 A1 | 12/1995 |
| WO | WO 03/08754 A1 | 10/2003 |

* cited by examiner

*Primary Examiner*—Frank S. Tsay
(74) *Attorney, Agent, or Firm*—Steve Rosenblatt

(57) ABSTRACT

A short radius exit from a window milled in casing is possible using a whipstock with a sloping surface in excess of 3.5° and a window mill whose diameter is reduced to a percentage generally below about 95% of the casing inside diameter in a mono-bore or non-through tubing application. The system provides a greater flexibility in choosing the window location and eliminates having to penetrate adjacent formations as compared to previous techniques using a longer exit radius. The decrease in mill diameter, as compared to previous techniques, limits stresses on the milling equipment to minimize equipment failures during window milling and subsequent drilling of the lateral.

13 Claims, 3 Drawing Sheets

SHORT RADIUS WHIPSTOCK SYSTEM

PRIORITY INFORMATION

This application claims the benefit of U.S. Provisional Application No. 60/440,268 on Jan. 15, 2003.

FIELD OF THE INVENTION

The field of this invention is whipstock design and the associated milling systems that are used with whipstocks particularly in application where short exit radius is necessary or desired.

BACKGROUND OF THE INVENTION

Typically, whipstocks are used to create laterals from an existing bore to reach an as yet untapped formation. Whipstocks have traditionally been fairly lengthy and have incorporated a sloping surface to direct a milling assembly through a casing wall to form an opening in the casing wall known as a window. After the window is fully formed, the milling assembly is removed and the whipstock guides a drilling assembly through the window to drill the lateral. Casings have what is known in the industry as a drift diameter. The drift diameter is the largest dimension a tool can be and still fit through the inside diameter of the casing. Typically, milling assemblies that are frequently delivered with a whipstock have had external diameters at or near the drift diameter or approximately 97% of the casing inside diameter. The angle of inclination on the whipstock face has typically been less than 3.5°. This small angle creates limitations depending the location of available exit points for laterals and location and composition of adjacent formations. The slight angle on the whipstock requires an exit point from the casing and an exit trajectory of the drill bit that undesirably penetrates an adjacent formation that might produce water or sand or it could be highly unconsolidated and difficult to drill or complete.

The apparatus and method of the present invention allows for shorter radius exits from a window than had been accomplished in the past. It employs whipstock face inclinations of greater than about 3.5° and a window mill diameter of less than 95% of the casing inside diameter. This combination allows for short radius exits and avoids overstressing the milling equipment that forms the window. Those skilled in the art will better appreciate the features of the claimed invention from a review of the description of the preferred embodiment and the claims, which appear below.

SUMMARY OF THE INVENTION

A short radius exit from a window milled in casing is possible using a whipstock with a sloping surface in excess of 3.5° and a window mill whose diameter is reduced to a percentage generally below about 95% of the casing inside diameter in a mono-bore or non-through tubing application. The system provides a greater flexibility in choosing the window location and eliminates having to penetrate adjacent formations as compared to previous techniques using a longer exit radius. The decrease in mill diameter, as compared to previous techniques, limits stresses on the milling equipment to minimize equipment failures during window milling and subsequent drilling of the lateral.

DETAILED DESCRIPTION OF THE DRAWINGS

DETAILED DESCRIPTION OF THE PREFERRED EMBODIMENT

Figure 5:
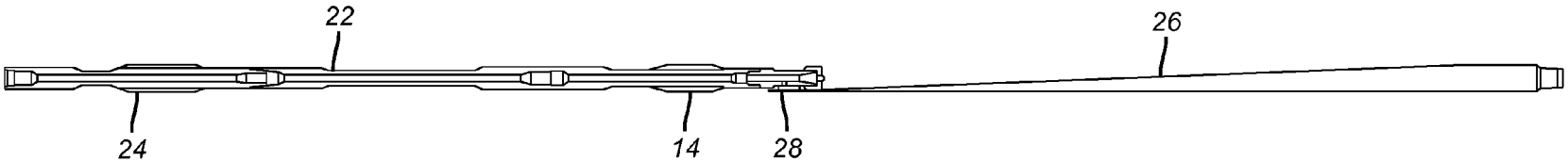
(PRIOR ART) FIG. 5
FIG. 5 is a section view with dimensions of a prior art system used in 9.63 inch casing that weighs 40 pounds per foot.

In the past, a whipstock 10 had a lug 12, which was generally secured at the lower end of a lower string mill 14. A window mill 16 starts the window 18 in the casing 20. A flexible joint 22 is mounted above the lower string mill 14. An upper string mill 24 (see FIG. 5) is mounted above the flexible joint 22. As shown in FIG. 5, the assembly of such equipment when used in a 9.63 inch casing weighing 40 pounds per foot would typically be used with a whipstock 10 having a sloping surface 26 oriented at about 2.3° from the longitudinal axis. This made for a whipstock length of about 247 inches. The window mill 16 had an outside diameter of about 8.195 inches and the mill assembly was about another 260 inches. The window mill 16 being up against the upper end 28 of the whipstock 10 together created a profile close to the drift diameter of the casing 20. It should be noted that the lower string mill 14 had a maximum diameter of about 8.125 inches, which is larger than the window mill 16 outside diameter but still less than the drift diameter of casing 20. The upper string mill 24 had a maximum diameter of 8.675 inches, which is even larger than the lower string mill 16 diameter but at the same time still smaller than the drift diameter of the casing 20, but not by much. The upper string mill was generally larger because by the time it reached the window that had already been milled by the window mill 16 and the lower string mill 14, the upper end 28 of the whipstock 10 would have been somewhat worn down so as not to allow the upper string mill 24 to get jammed. The objective of prior designs was to get the mills as close as possible to the drift diameter of the casing 20. As long as the combined diameter of the upper end 28 of the whipstock 10 and the window mill 16 was less than the drift diameter, the assembly would pass quickly to the desired kick-off point for the lateral without serious concerns of getting it stuck. Additionally, the bigger the window mill 16 diameter the bigger the window 18 and the easier it was for a drill to make an exit for the drilling of the lateral. The downside of this arrangement using a downhole assembly having a maximum outside diameter of 97% or greater of the casing drift diameter is that it would need to exit in a fairly long radius to avoid failure from lateral overstressing. The use of a long exit radius also required a very small angle on surface 26. The overall whipstock length would grow as the angle became smaller to accommodate the expected stresses from forming the window with an outside diameter of the milling assembly closely approximating the drift diameter. The long exit radius also required the lateral to penetrate adjacent formations before reaching the zone of interest. This could result in completion problems if the zone adjacent the window produced sand or water or was very unconsolidated. The use of a whipstock 10 with face angles on surface 26 of 3.5° or less often required the positioning of the window well above the target zone and, at times, in an inconvenient location in the casing for milling to begin.

Figure 1:
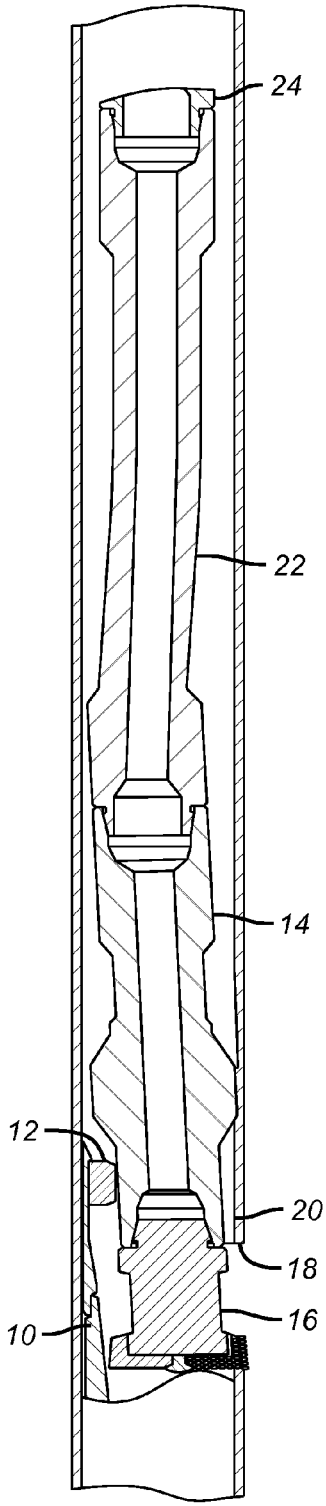
(PRIOR ART) FIG. 1
FIG. 1 is a prior art window milling system starting to form the window.
Figure 2:
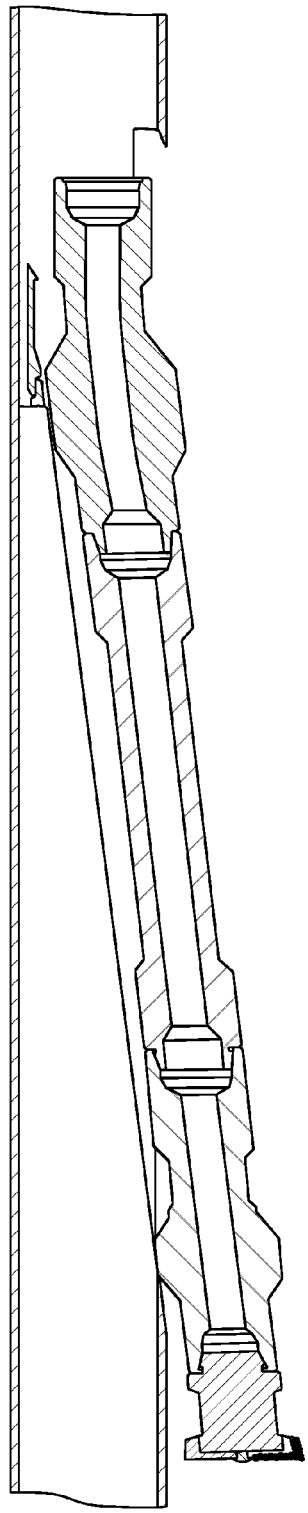
(PRIOR ART) FIG. 2
FIG. 2 is the system of FIG. 1 showing the window nearly fully formed.
Figure 3:
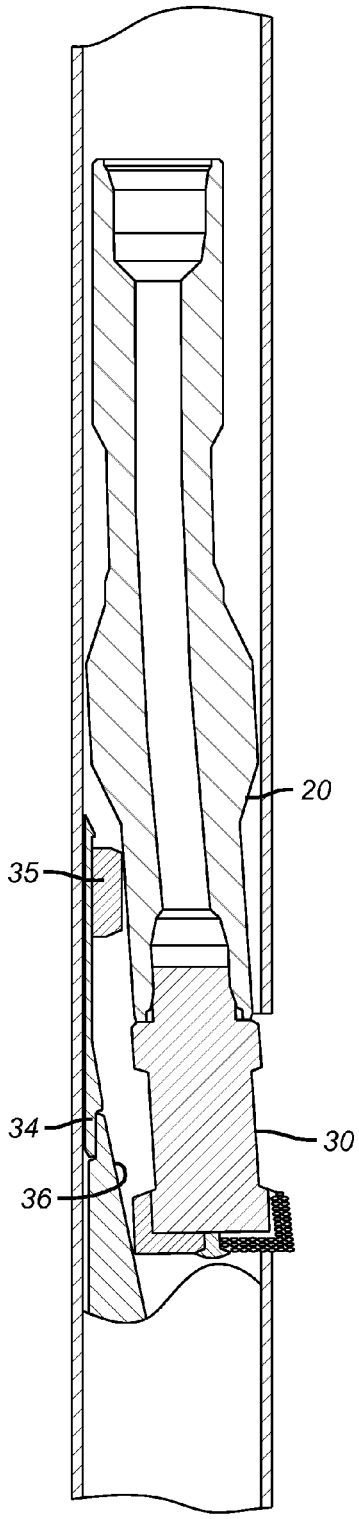
FIG. 3 shows the present invention initiating the window.
Figure 4:
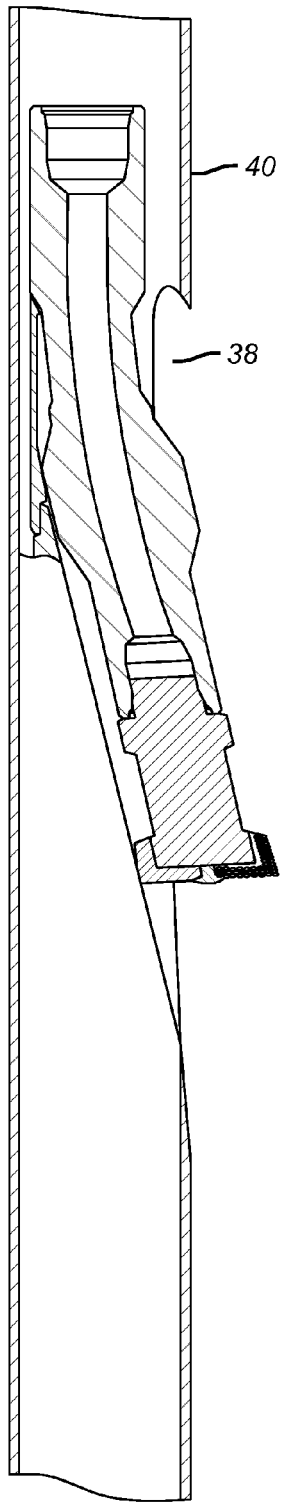
FIG. 4 is the view of FIG. 3 with the window nearly fully formed.
Figure 6:
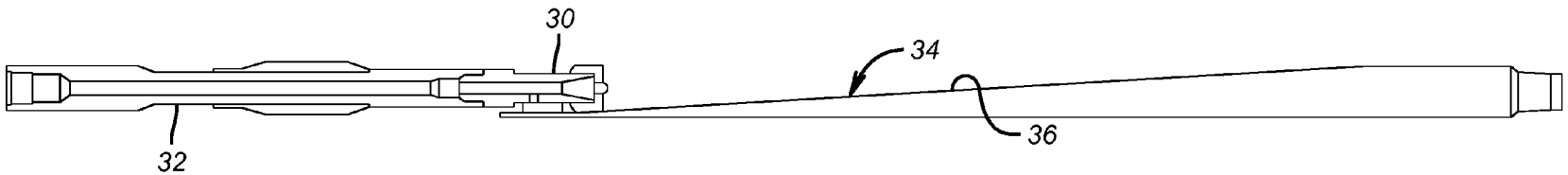
FIG. 6 is the present invention that is used to create an ultra short radius in the same casing as the example of FIG. 5 showing dimensions to allow comparison.

To resolve these shortcomings of the prior designs, the present invention has been developed. It features a window mill 30 and a lower string mill 32. The whipstock 34 has a lug 35 that allows connection to the string mill 32 for the trip downhole. The whipstock face 36 is at an angle greater than 3.5° with the preferred range at 4.5+/−0.5°. As seen by comparing FIGS. 5 and 6 the length of the whipstock 34 having an angle of 4.5° and a length of 97.50 inches, is less than half the 247 inch length of the whipstock 27 that has a slope of 2.3° on surface 26. What makes the higher slope angle on surface 36 possible without overstressing the milling assembly is that its outside diameter is less than 95% of the drift diameter with a preferred range in the order of 70–75% of the casing drift diameter. As seen in comparing FIGS. 5 and 6, the outside diameter of the window mill and whipstock top has been decreased from 8.195 inches to 6.25 inches for the same casing size. The string mill diameter has been reduced from 8.215 inches to 6.25 inches and the assembly in FIG. 6 omits the flexible joint 22 and the upper string mill 24. As a result, the assembly in FIG. 6 is about a third the length of the FIG. 5 assembly. It exits at a far larger radius due to the higher slope of the whipstock face. Overstresses are avoided by a decrease in diameter of the bottom hole assembly. The base of the whipstock in FIGS. 5 and 6 remains the same to facilitate the anchoring process. Trimming the diameter of the assembly relocates the maximum stress region from the previous design. As seen in FIG. 1, the maximum stress region, when starting the window, is in the area of the connection between the window mill 16 and lower string mill 16. By comparison, FIG. 3 illustrates the present invention with the higher slope angle on the whipstock 34 and the smaller diameter on the window mill 30 and string mill 32. As a result of the changed parameters, the maximum stressed region has been relocated upwardly to the upper end of the string mill 32. Similarly, when finishing the window, the maximum stressed region has been moved down from the upper string mill 24 to the connection between the window mill 30 and the string mill 32. This is schematically illustrated by comparing FIGS. 2 and 4.

Those skilled in the art will appreciate that the present invention allows for shorter bottom hole assemblies and lateral exits at far shorter radii than had been possible with previous designs. The angle on the whipstock face has been altered to a range of greater than 3.5° with the preferred range of 4° to 5°. At the same time the maximum dimension of the assembly where the whipstock is connected to the window mill has been reduced to less than 95% of the casing drift diameter, with the preferred range being 70–75% of the drift diameter. Preferably, as shown in FIG. 6, the string mill 32 can have the same outside diameter as around the whipstock 34 and the window mill 30. Alternatively, the string mill can be somewhat larger. Optionally, there can be only one string mill 32 but use of more than one string mill is within the scope of the invention. Ultimately, after the window 38 is milled with the assembly shown in FIG. 6, a drill bit (not shown) is inserted through the window 38 in casing 40 for the far shorted exit radius for the new lateral. The combination of the higher slope on the whipstock to enable the shorter radius and the smaller diameter of the window mill 30 and the string mill 32 prevents overstress from reducing the exit radius of the milling equipment in making the window. Optionally, the size of the subsequent drill bit can be chosen to pass through the window previously made or to be somewhat larger, thereby enlarging the window and then exiting to drill the lateral. Reducing the size of the drill bit as a percentage of the drift diameter, along the same lines as the window milling assembly dimensions of the present invention, further aids in the drilling of a short radius lateral. The ability to exit with such a short radius, avoids the problems previously described when using the prior designs and having to penetrate adjacent formations or being faced with having to locate a window at an undesirable location in the casing in order to wind up in the desired formation while using a large exit radius.

The above description of the preferred embodiment is merely illustrative of the optimal way of practicing the invention and various modifications in form, size, material or placement of the components can be made within the scope of the invention defined by the claims below.

We claim:

1. A window milling system for a tubular having a drift diameter, comprising:

a whipstock having a longitudinal axis and a sloping surface;

a window mill securable to an upper end of said whipstock for guidance by said sloping surface for forming the window;

said milling system further comprising at least one of an angle on said sloping surface from said longitudinal axis of greater than 3.5° and the combined dimension of said window mill and said whipstock at the location of initial attachment being less than about 95% of the drift diameter of the tubular.

2. The system of claim 1, wherein:

said angle on said sloping surface is between about 4° and 5°.

3. The system of claim 1, wherein:

said combined dimension of said window mill and said whipstock at the location of initial attachment is in the range of about 70–75% of the drift diameter of the tubular.

4. The system of claim 2, wherein:

said combined dimension of said window mill and said whipstock at the location of initial attachment is in the range of about 70–75% of the drift diameter of the tubular.

5. The system of claim 1, further comprising:

a string mill mounted above said window mill;

whereupon initial formation of the window by said window mill the maximum stressed region is located above said string mill.

6. The system of claim 1, further comprising:

a string mill mounted above and adjacent said window mill;

whereupon completion of a window by said string mill the maximum stressed region is between said window mill and said string mill.

7. The system of claim 5, further comprising:

a string mill mounted above and adjacent said window mill;

whereupon completion of a window by said string mill the maximum stressed region is between said window mill and said string mill.

8. The system of claim 1, further comprising:

a single string mill mounted above and adjacent said window mill;

whereupon the window can be completed with said window mill and said single string mill.

9. The system of claim 8, wherein:

the diameter of said string mill is at least as large as the combined dimension of said window mill and said whipstock at the location of initial attachment.

10. The system of claim 8, further comprising:

at least one other mill mounted above said single string mill.

11. The system of claim 10, wherein:

the diameter of said other mill is at least equal to the diameter of said single string mill.

12. The system of claim 4, wherein:

a string mill mounted above said window mill;

whereupon initial formation of the window by said window mill the maximum stressed region is located above said string mill.

13. The system of claim 12, wherein:

said maximum stressed region is between said window mill and said string mill during completion of a window by said string mill.

* * * * *